US010453382B2

(12) United States Patent
Taguchi

(10) Patent No.: US 10,453,382 B2
(45) Date of Patent: Oct. 22, 2019

(54) LIGHT EMITTING APPARATUS, DISPLAY SECTION, AND CONTROLLER CIRCUIT

(71) Applicant: NICHIA CORPORATION, Anan-shi (JP)

(72) Inventor: Haruhisa Taguchi, Yokohama (JP)

(73) Assignee: NICHIA CORPORATION, Anan-shi (JP)

( * ) Notice: Subject to any disclaimer, the term of this patent is extended or adjusted under 35 U.S.C. 154(b) by 133 days.

(21) Appl. No.: 14/882,460

(22) Filed: Oct. 14, 2015

(65) Prior Publication Data

US 2016/0104416 A1 Apr. 14, 2016

(30) Foreign Application Priority Data

Oct. 14, 2014 (JP) ..... 2014-210327

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2300/0452* (2013.01); *G09G 2320/0242* (2013.01); *G09G 2320/0666* (2013.01); *G09G 2340/0457* (2013.01)

(58) Field of Classification Search
CPC ..... G09G 3/32; G09G 2320/0242; G09G 2320/0666; G09G 2300/0452
USPC ..... 345/690, 698, 39–40, 44–48, 55, 59, 67, 345/72–73, 82–84; 315/39.63, 42–43, 315/84.61, 145, 147, 167, 202, 232, 235, 315/260, 334
See application file for complete search history.

(56) References Cited

U.S. PATENT DOCUMENTS

| | | | |
|---|---|---|---|
| 2007/0046689 | A1 | 3/2007 | Tokimoto et al. |
| 2008/0030527 | A1 | 2/2008 | Namie et al. |
| 2009/0213036 | A1 | 8/2009 | Hara |
| 2010/0020115 | A1 | 1/2010 | Furuta |

(Continued)

FOREIGN PATENT DOCUMENTS

| | | |
|---|---|---|
| JP | 2006-259403 | 9/2006 |
| JP | 2008-152080 | 7/2008 |

(Continued)

*Primary Examiner* — Vinh T Lam
(74) *Attorney, Agent, or Firm* — Mori & Ward, LLP

(57) ABSTRACT

Second light emitting elements and third light emitting elements are disposed at common grid-points that are adjacent in four directions to each grid-point where a first light emitting element is disposed. The controller circuit samples input data at each grid-point to generate display data to illuminate each light emitting element; controls first light emitting element illumination based on first light emitting element color information contained in first display data, which are display data sampled at each grid-point where a first light emitting element is disposed; controls second light emitting element illumination based on second light emitting element color information contained in second display data, which are display data sampled at each grid-point where a second and third light emitting element is disposed; and controls third light emitting element illumination based on third light emitting element color information contained in the second display data.

20 Claims, 12 Drawing Sheets

(56) References Cited

U.S. PATENT DOCUMENTS

| | | | | |
|---|---|---|---|---|
| 2010/0225567 | A1* | 9/2010 | Koebrich | G09G 3/20 345/55 |
| 2011/0157250 | A1* | 6/2011 | Hasegawa | G09G 3/3225 345/690 |
| 2014/0152714 | A1* | 6/2014 | Nakagawa | H04N 9/67 345/690 |
| 2015/0002562 | A1* | 1/2015 | Phan | G09G 3/20 345/694 |
| 2015/0009194 | A1* | 1/2015 | Kim | G09G 3/3233 345/211 |
| 2015/0015466 | A1* | 1/2015 | Feng | G09G 3/2003 345/77 |
| 2015/0248855 | A1* | 9/2015 | Kim | G09G 3/2074 345/590 |
| 2016/0027357 | A1* | 1/2016 | Guo | G09G 3/32 345/694 |
| 2016/0240593 | A1* | 8/2016 | Gu | G09G 3/3225 |
| 2016/0247440 | A1* | 8/2016 | Shi | G09G 3/36 |
| 2016/0275838 | A1* | 9/2016 | Sun | G02F 1/1362 |
| 2016/0300519 | A1* | 10/2016 | Shi | G09G 3/2003 |
| 2017/0162101 | A1* | 6/2017 | Ohara | G09G 3/3233 |

FOREIGN PATENT DOCUMENTS

| | | |
|---|---|---|
| JP | 2009-230096 | 10/2009 |
| JP | 2010-026426 | 2/2010 |
| WO | WO 00/57398 | 9/2000 |

* cited by examiner

LIGHT EMITTING APPARATUS, DISPLAY SECTION, AND CONTROLLER CIRCUIT

CROSS-REFERENCE TO RELATED APPLICATIONS

The present application claims priority under 35 U.S.C. 119 to Japanese Patent Application No. 2014-210327 filed Oct. 14, 2014. The contents of that application are incorporated herein by reference in their entirety.

BACKGROUND OF THE INVENTION

1. Field of the Invention

The present disclosure relates to a light emitting apparatus provided with light emitting elements such as light emitting diodes (LEDs) or laser diodes (LDs) appropriate for use as a general-purpose image display device. The present disclosure also relates to the display section and controller circuit components of the light emitting apparatus.

2. Description of the Related Art

Currently, high luminosity light emitting elements such as LEDs and LDs have been developed to emit all of the three primary colors: red, green, and blue (RGB). This has made it possible to make large screen, full-color, self-emitting (i.e. not backlight dependent) displays. Among the newly developed displays, LED displays feature attributes including light weight, thin outline, and high luminosity with low power consumption. Accordingly, there is rapidly increasing demand for large screen LED displays that can be used outdoors as well as indoors. Demand has also developed, from a price-performance standpoint, for displays that support high-resolution while restraining the number of light emitting elements employed.

International patent disclosure WO 00/057398 describes a display section that is representative of those used in related art image display applications. FIG. 9 is a schematic showing the layout of light emitting elements that make up the display section. The light emitting elements are red light emitting elements 20*a*, blue light emitting elements 20*b*, and green light emitting elements 20*c*, which emit the three RGB primary colors. RGB light emitting elements 20*a*, 20*b*, 20*c* are disposed at center-points between four adjacent grid-points 21 of the display matrix. Green light emitting elements 20*c* are disposed in an oblique crisscrossing (diamond) pattern, and red and blue light emitting elements 20*a*, 20*b* are disposed alternately in a similar oblique crisscrossing pattern.

If red light emitting elements 20*a* (designated first light emitting elements 20*a*) are focused on, each red light emitting element 20*a* is disposed at the center of four adjacent grid-points 21 as shown in FIG. 10. Image data sampled at points corresponding to the four grid-points 21 include red color information, which is used as a basis for activating the red light emitting element 20*a* at the center of those four grid-points 21. In contrast, each pixel of the display is centered at a grid-point 21 and is formed by one red light emitting element 20*a*, one blue light emitting element 20*b*, and two green light emitting elements 20*c*, which are adjacent and form a group surrounding that grid-point 21.

FIGS. 11-14 are schematic drawings showing groups 23-31 of RGB light emitting elements 20*a*, 20*b*, 20*c*, which are activated in a time sequenced manner. For example, light is emitted (by light emitting element activation) at pixels formed by the adjacent groups 23, 24, 25, 26 of light emitting elements shown in FIG. 11. Subsequently, as shown in FIG. 12, light is emitted at the pixel corresponding to group 27, which is formed by the green light emitting element 20*c* and blue light emitting element 20*b* in the right half of group 23, and the red light emitting element 20*a* and green light emitting element 20*c* in the left half of group 24. Light is also emitted at the pixel corresponding to group 28, which is formed by the green light emitting element 20*c* and blue light emitting element 20*b* in the right half of group 25, and the red light emitting element 20*a* and green light emitting element 20*c* in the left half of group 26.

Next, as shown in FIG. 13, light is emitted at the pixel corresponding to group 29, which is formed by the green light emitting element 20*c* and blue light emitting element 20*b* in the lower half of group 23, and the red light emitting element 20*a* and green light emitting element 20*c* in the upper half of group 25. Light is also emitted at the pixel corresponding to group 30, which is formed by the green light emitting element 20*c* and blue light emitting element 20*b* in the lower half of group 24, and the red light emitting element 20*a* and green light emitting element 20*c* in the upper half of group 26.

Subsequently, as shown in FIG. 14, light is emitted at the pixel corresponding to group 31, which is formed by the blue light emitting element 20*b* and green light emitting element 20*c* in the lower half of group 27, and the green light emitting element 20*c* and red light emitting element 20*a* in the upper half of group 28.

In the system described above, all the input display data corresponding to the grid-points 21 are output to the light emitting elements 20*a*, 20*b*, 20*c* by control that is implemented as a function of time. Pixel groups 23-31, which are activated with intervening time increments, overlap in both the horizontal and vertical directions. Since light emission in these pixel overlap regions becomes averaged in time, reduced image resolution arises in the both horizontal and vertical directions.

The present invention was developed to resolve this type of problem. Thus, it is an object of the present invention to provide a light emitting apparatus, display section, and controller circuit that increase resolution while reducing the number of light emitting elements employed.

SUMMARY OF THE INVENTION

To achieve the object cited above, one light emitting apparatus of the present invention is provided with a display section having a plurality of light emitting elements disposed in a matrix array, and a controller circuit that controls activation (illumination) of the light emitting elements in accordance with input data corresponding to the image to be displayed by the display section. First light emitting elements, second light emitting elements, and third light emitting elements are provided to emit the three primary colors. The display matrix is made up of a plurality of grid-points; second light emitting elements and third light emitting elements are disposed at grid-points in four directions adjacent to each grid-point where a first light emitting element is disposed; and each second light emitting element and third light emitting element is disposed at a common grid-point. The controller circuit samples input data at each grid-point to generate display data that activate each light emitting element; controls first light emitting element activation based on first light emitting element color information contained in first display data, which are display data sampled at each grid-point where a first light emitting element is disposed; controls second light emitting element activation based on second light emitting element color information contained in second display data, which are display data sampled at each grid-point where a second and third light emitting element is disposed; and controls third light emitting element activation based on third light emitting element color information contained in the second display data.

With this system, a high resolution light emitting apparatus can be realized even when the number of light emitting elements is restrained. For example, compared to a scheme where first, second, and third light emitting elements comprising the three primary colors are disposed as a unit at each grid-point and input data is sampled at each grid-point, the system described above can achieve the same degree of resolution with a display section employing half the number of light emitting elements.

BRIEF DESCRIPTION OF THE DRAWINGS

More complete appreciation of the invention and many of its attendant advantages will be readily obtained as the invention becomes better understood by reference to the subsequent detailed description considered in conjunction with the accompanying drawings.

DETAILED DESCRIPTION OF THE EMBODIMENTS

Figure 1A:
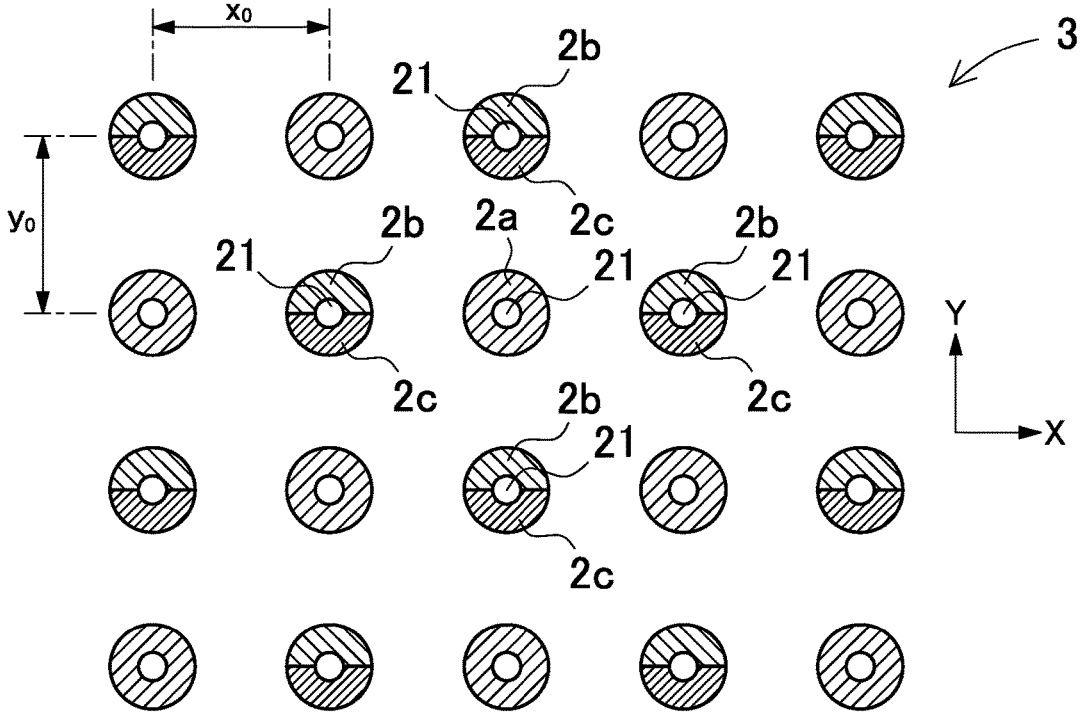
FIGS. 1A, 1B, and 1C are schematic drawings showing layout examples for light emitting elements that make up the display section of an embodiment of the present invention.

The following describes embodiments of the present invention with reference to the accompanying drawings. Here, similar reference numbers designate corresponding or identical components in the drawings. However, the following light emitting apparatus descriptions are merely specific examples representative of the technology associated with the present invention, and in the absence of specific annotation, the present invention is not limited to implementations described below. Further, content used to describe one implementation or embodiment may also be applied to describe other implementations or embodiments. Properties such as the size and spatial relation of components shown in the figures may be exaggerated for the purpose of clear explanation.

Figure 1B:
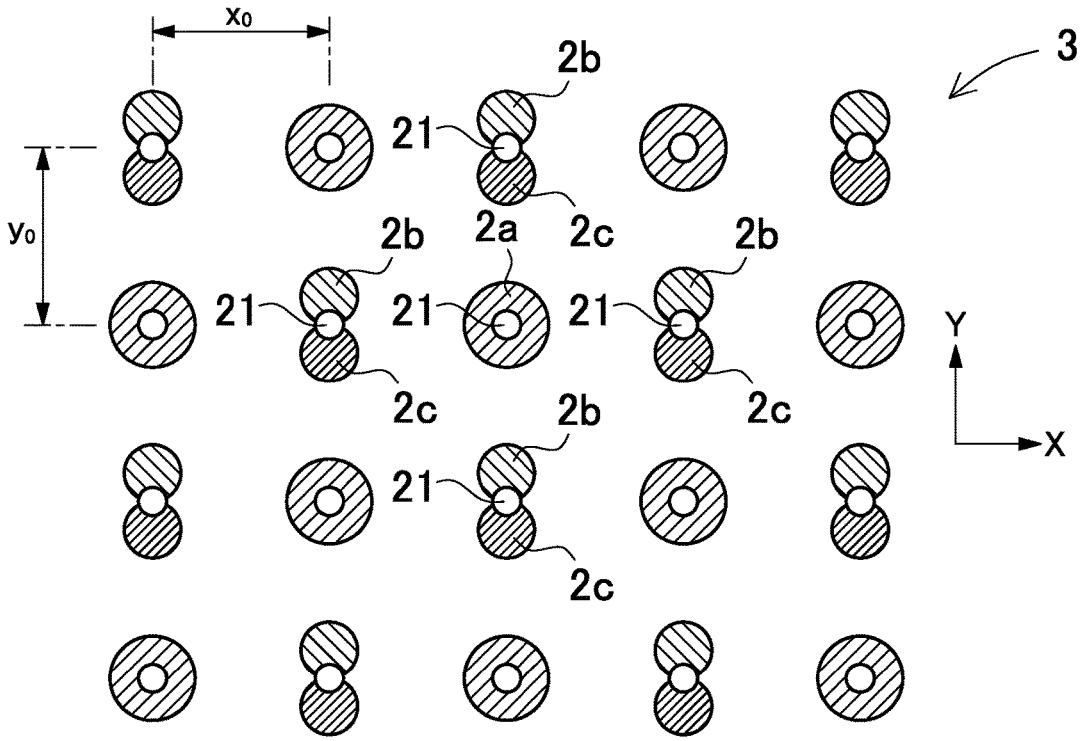
Figure 2:
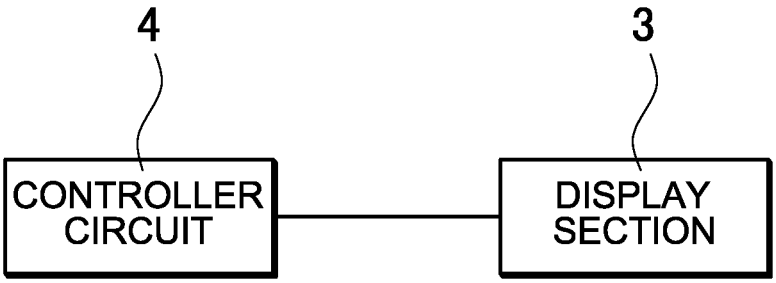
FIG. 2 is a block diagram of the light emitting apparatus control system.

The following describes implementation of a light emitting apparatus for the present first embodiment based on FIGS. 1A, 1B, and 2. FIGS. 1A and 1B are schematic drawings showing layout examples for light emitting elements that make up the display section 3. Specifically, FIG. 1A shows an example where second light emitting elements 2*b* and third light emitting elements 2*c* are mounted in a common package, while FIG. 1B shows and example where second light emitting elements 2*b* and third light emitting elements 2*c* are mounted in separate packages. FIG. 2 is a block diagram of the light emitting apparatus control system. The light emitting apparatus is provided with a display section 3 that has a plurality of light emitting elements disposed in a matrix array, and a controller circuit 4 that controls activation (illumination) of the light emitting elements according to input data representing the image to be displayed by the display section 3. The plurality of light emitting elements emit light of the three primary colors, and the three color light emitting elements are first light emitting elements 2*a*, second light emitting elements 2*b*, and third light emitting elements 2*c*. The light emitting apparatus is installed in an image display device.

The display matrix 3 is made up of a plurality of grid-points 21. Second light emitting elements 2*b* and third light emitting elements 2*c* are disposed at grid-points in four directions next to each grid-point where a first light emitting element 2*a* is disposed, and second light emitting elements 2*b* and third light emitting elements 2*c* are disposed at common grid-points. As shown in FIG. 1A, each second light emitting element 2*b* and third light emitting element 2*c* can be mounted in the same package. Or, as shown in FIG. 1B, each second light emitting element 2*b* and third light emitting element 2*c* can be carried in separate packages. While each second light emitting element 2*b* and third light emitting element 2*c* can be mounted on the circuit board after packaging, those light emitting elements can also be directly mounted on the circuit board. Similarly, each first light emitting element 2*a* can be mounted on the circuit board after packaging, or directly mounted on the circuit board.

Figure 1C:
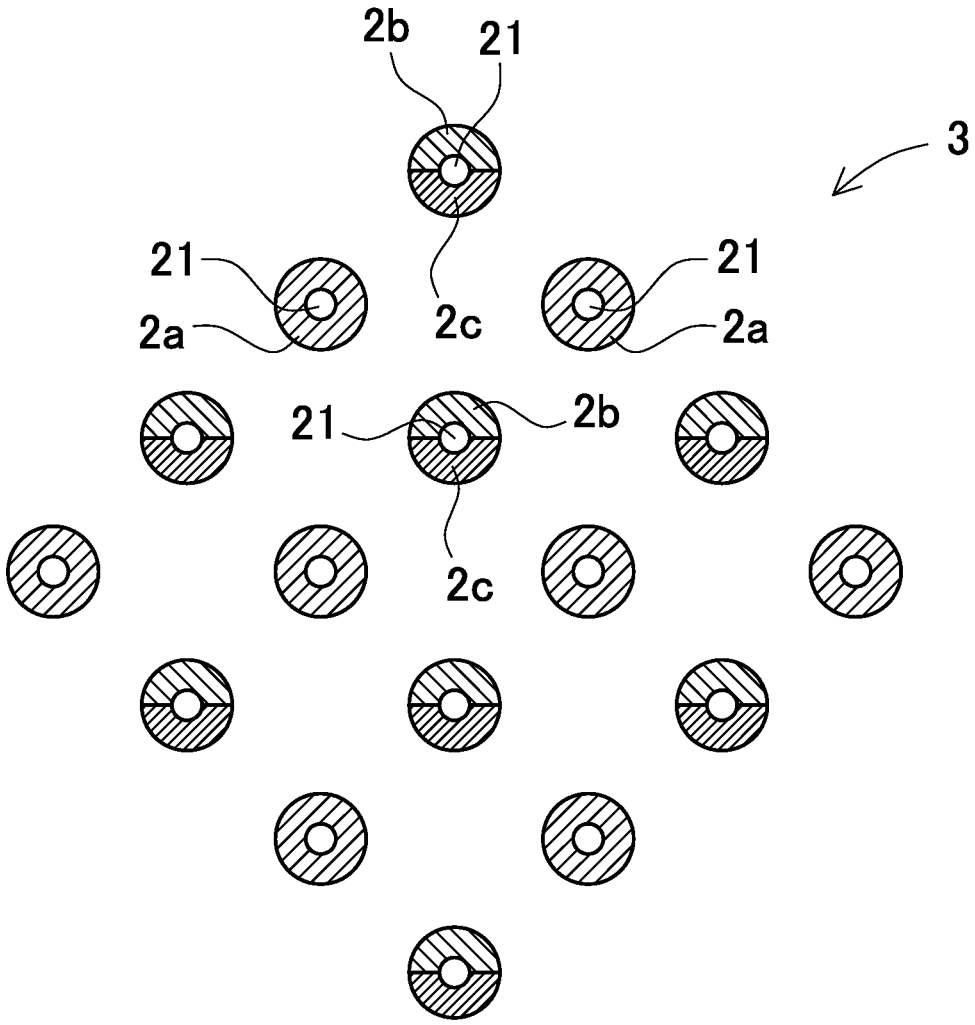

First light emitting elements 2*a* and second and third light emitting elements 2*b*, 2*c* are disposed with a pitch (distance between elements) of $x_0$ in the x-direction and a pitch of $y_0$ in the y-direction. In FIGS. 1A and 1B, the x-direction is horizontal and the y-direction is vertical, and those figures show the case where second and third light emitting elements 2*b*, 2*c* are adjacent to first light emitting elements 2*a* in both the horizontal and vertical directions. However, the present invention is not limited to that layout. For example, the coordinate system for either FIG. 1A or FIG. 1B could be rotated to make second and third light emitting elements 2*b*, 2*c* adjacent to first light emitting elements 2*a* in oblique (diagonal) directions (e.g. FIG. 1A or FIG. 1B can be rotated 45° to form the matrix shown in FIG. 1C). Further, at grid-points where second and third light emitting elements 2*b*, 2*c* are disposed in the examples of FIGS. 1A and 1B, second light emitting elements 2*b* are shown above (further in the positive y-direction than) third light emitting elements 2*c*. However, the positional relation of the second and third light emitting elements 2*b*, 2*c* is not limited to that arrangement, and for example, third light emitting elements 2*c* could also be positioned above second light emitting elements 2*b* in the y-direction.

The controller circuit 4 samples input data for each grid-point in the display section 3 matrix and generates display data to activate (illuminate) each light emitting element. Here, display data are the information necessary to illuminate each light emitting element and include parameters such as element luminosity, brightness, and current flow.

Figure 9:
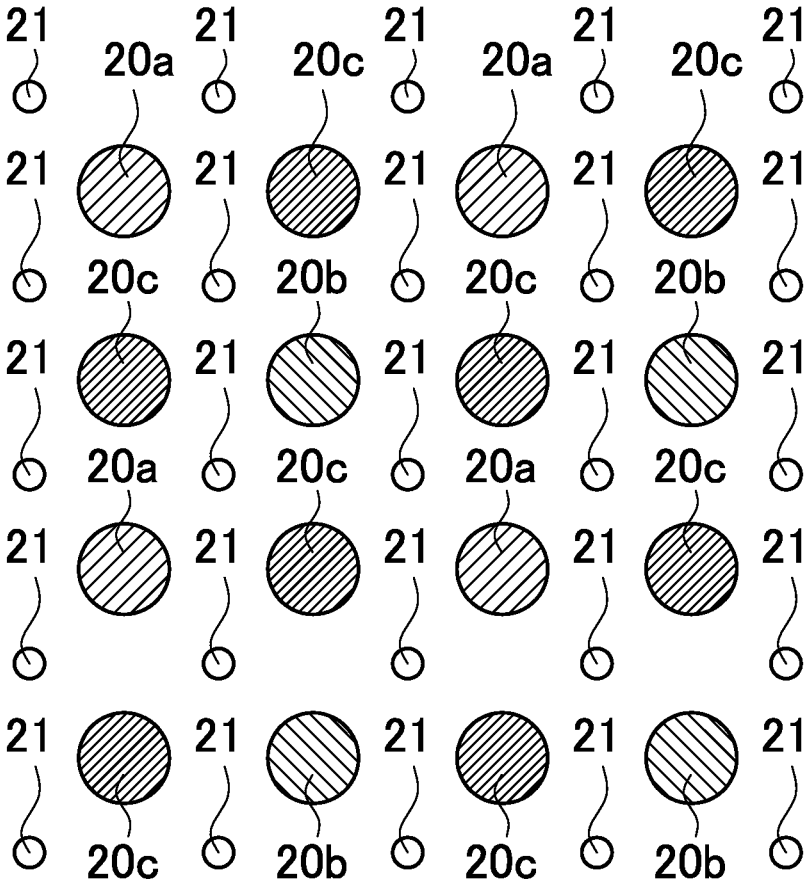
FIG. 9 RELATED ART
FIG. 9 is a schematic drawing showing the layout of light emitting elements that make up a related art display section.
Figure 10:
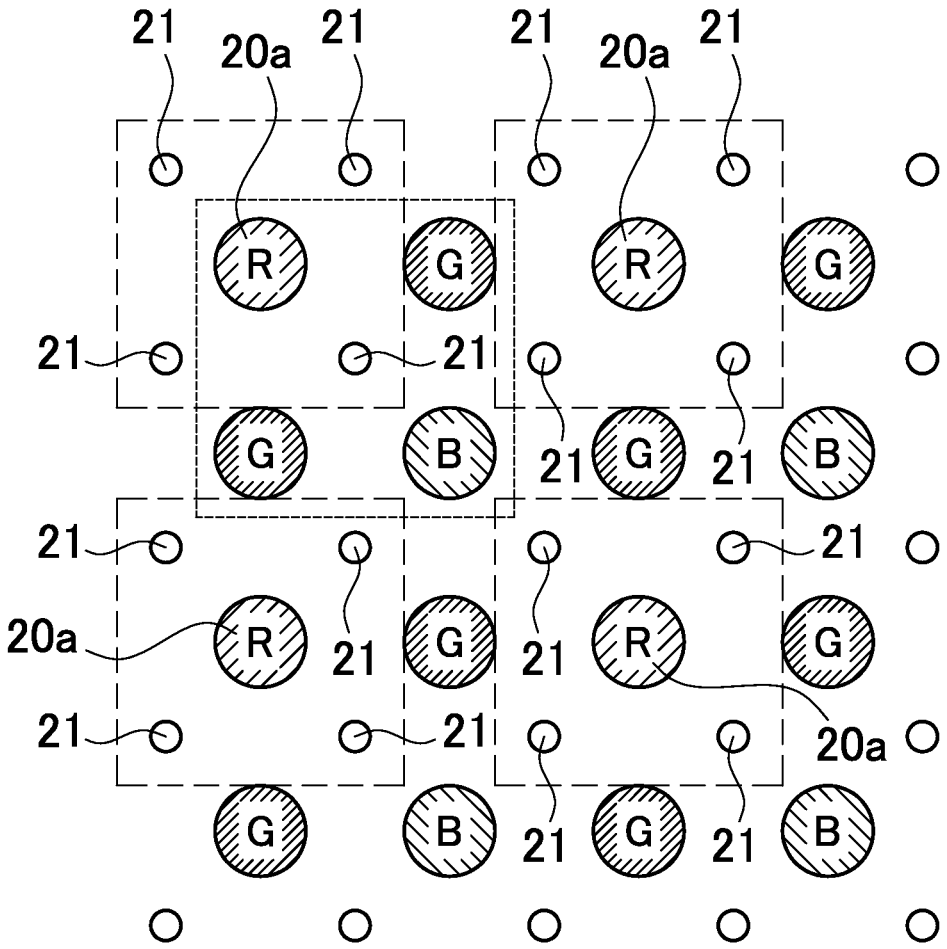
FIG. 10 RELATED ART
FIG. 10 is a conceptual drawing showing the positional relation between grid-points and activated light emitting elements for representing input data sampled in the related art system.
Figure 11:
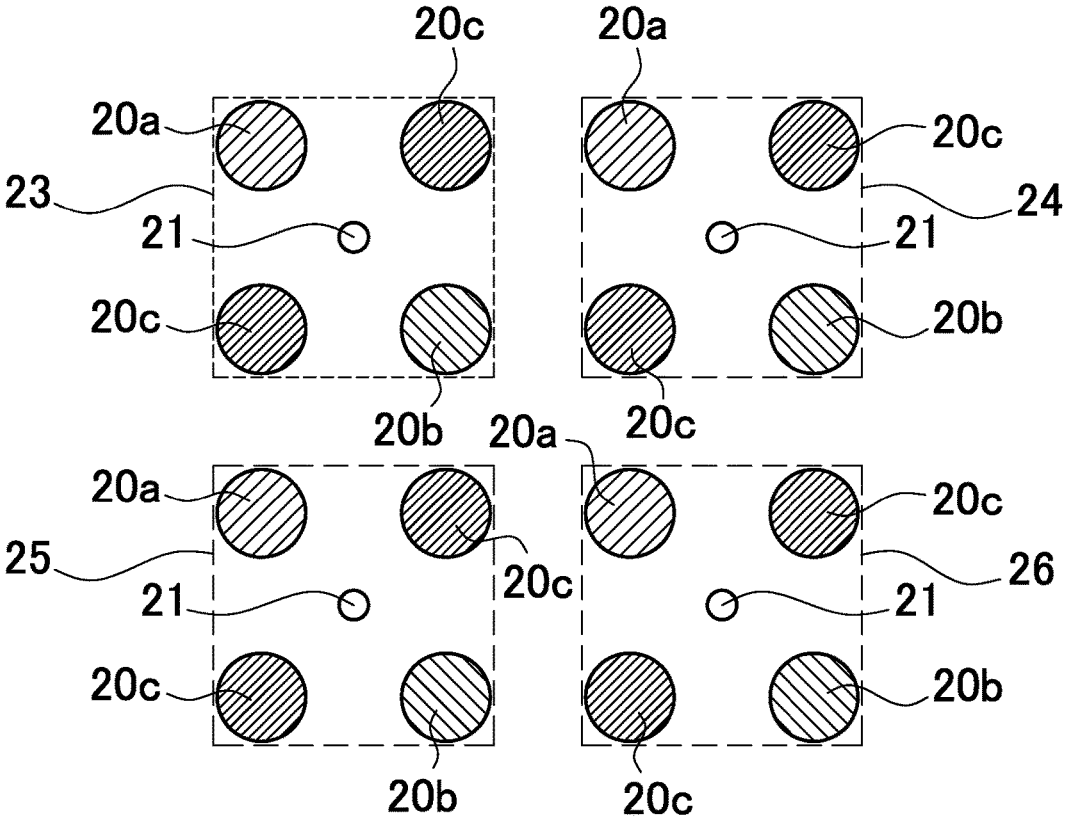
FIG. 11 RELATED ART
FIG. 11 is a schematic drawing showing red, blue, and green light emitting element pixel groups activated at a given time in the related art system.
Figure 12:
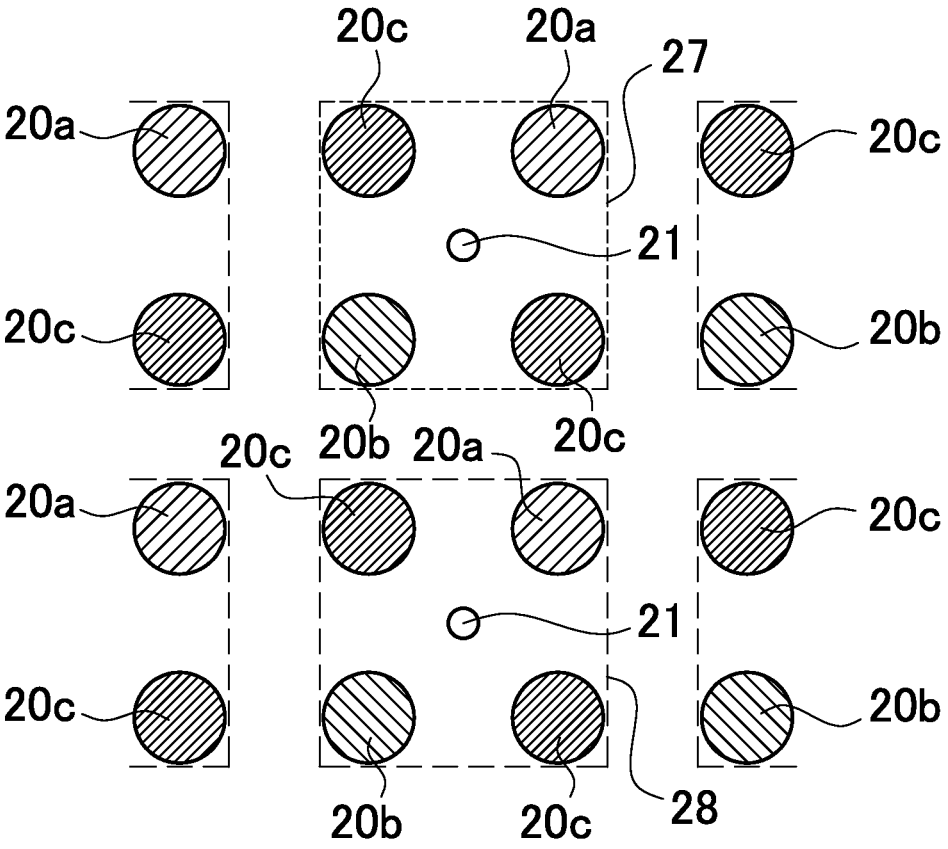
FIG. 12 RELATED ART
FIG. 12 is a schematic drawing showing red, blue, and green light emitting element pixel groups activated after a time increment in the related art system.
Figure 13:
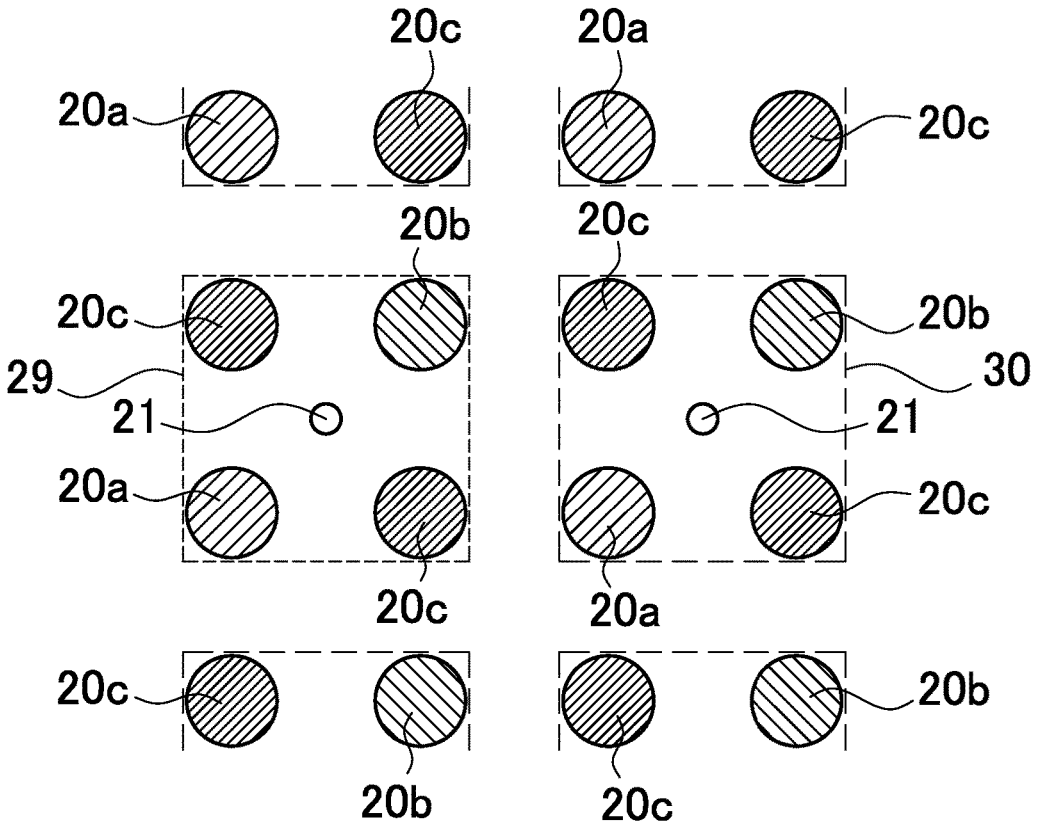
FIG. 13 RELATED ART
FIG. 13 is a schematic drawing showing red, blue, and green light emitting element pixel groups activated after another time increment in the related art system.
Figure 14:
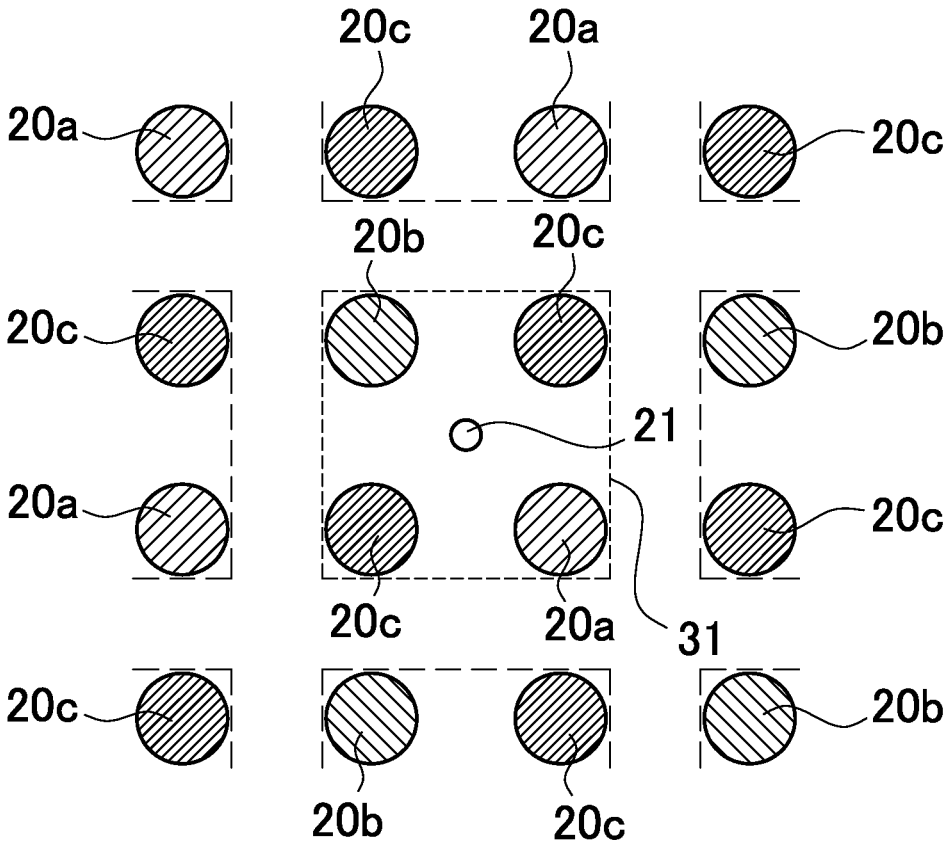
FIG. 14 RELATED ART
FIG. 14 is a schematic drawing showing red, blue, and green light emitting element pixel groups activated after another time increment in the related art system.

Data sampling grid-points are not established in between RGB light emitting element locations as in layouts such as shown in FIG. 9, but rather the data sampling points correspond to grid-points that coincide with light emitting element locations. Since this arrangement is characterized by one-to-one correspondence between grid-points and light emitting elements, computations that result in time averaging are superfluous.

The controller circuit 4 performs illumination control of first light emitting elements 2*a* according to first light emitting element 2*a* color information contained in first display data, which are display data sampled at grid-points where first light emitting elements are disposed. The controller circuit 4 also performs illumination control of second and third light emitting elements 2*b*, 2*c* according to second light emitting element 2*b* color information and third light emitting element 2*c* color information contained in second display data, which are display data sampled at each grid-point where a second and third light emitting element is disposed.

While each emission color of the first, second, and third light emitting elements 2*a*, 2*b*, 2*c*, which establish the three primary colors, can be formed by any combination of colors, it is preferable for the peak emission wavelengths of the second and third light emitting elements 2*b*, 2*c* to both be either shorter or longer than the peak emission wavelength of the first light emitting element 2*a*. Specifically, first light emitting elements 2*a* are either red or blue. This enables realization of a light emitting apparatus with superior color mixing capability. In the present embodiment, first light emitting elements 2*a* are red, and second light emitting elements 2*b* are either blue or green. When the emission color of second light emitting elements 2*b* is blue, third light emitting elements 2*c* emit green light, and when the emission color of second light emitting elements 2*b* is green, third light emitting elements 2*c* emit blue light.

Figure 3:
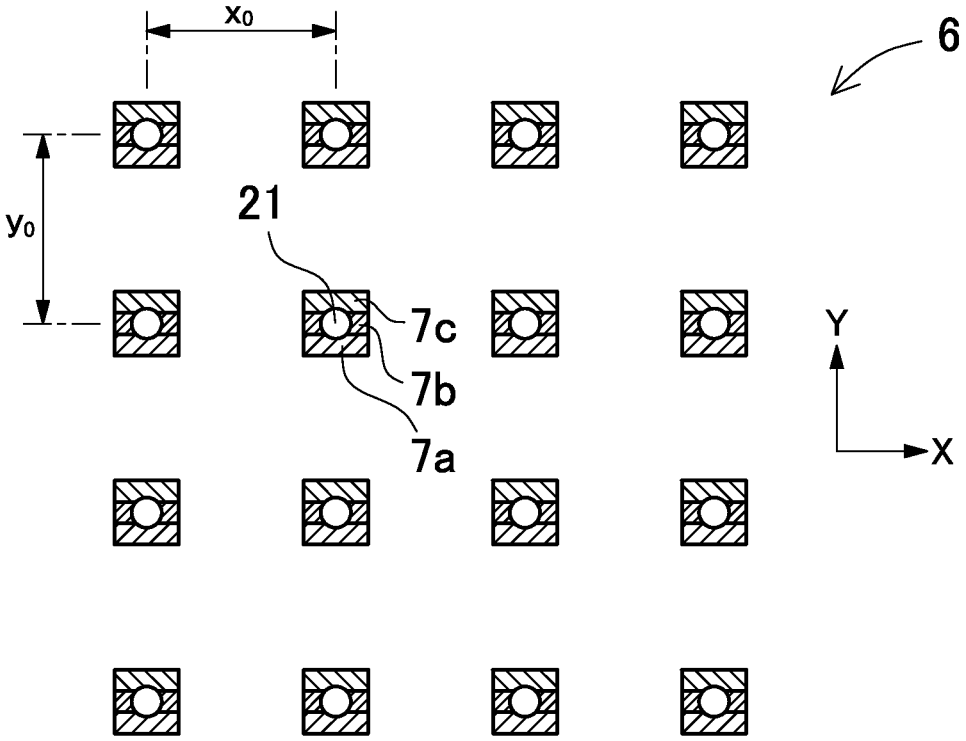
FIG. 3 is a schematic drawing showing a layout example for light emitting elements that make up the display section of a comparison example.

FIG. 3 is a schematic drawing showing the layout of light emitting elements that make up the display section 6 in a comparison example. In the comparison light emitting apparatus, there are no constraints on the number of light emitting elements allocated (as in the present embodiment), and a pixel group composed of a first light emitting element 7*a*, a second light emitting element 7*b*, and a third light emitting element 7*c* representing the three primary colors is disposed at each grid-point of the display section 6. In this example, the first light emitting element 7*a* emits red light, the second light emitting element 7*b* emits green light, and the third light emitting element 7*c* emits blue light.

In the comparison example as well, the controller circuit 4 samples input data for each grid-point in the display section 6 matrix and generates display data to activate (illuminate) each light emitting element. In this case, the display data are sampled at each grid-point, and a light emitting element group that includes a first light emitting element 7*a*, second light emitting element 7*b*, and third light emitting element 7*c* is disposed at each grid-point. From that data, the controller circuit 4 controls illumination of first light emitting elements 7*a* located at each grid-point based on first light emitting element 7*a* color information, controls illumination of second light emitting elements 7*b* located at each grid-point based on second light emitting element 7*b* color information, and controls illumination of third light emitting elements 7*c* located at each grid-point based on third light emitting element 7*c* color information.

Figure 4:
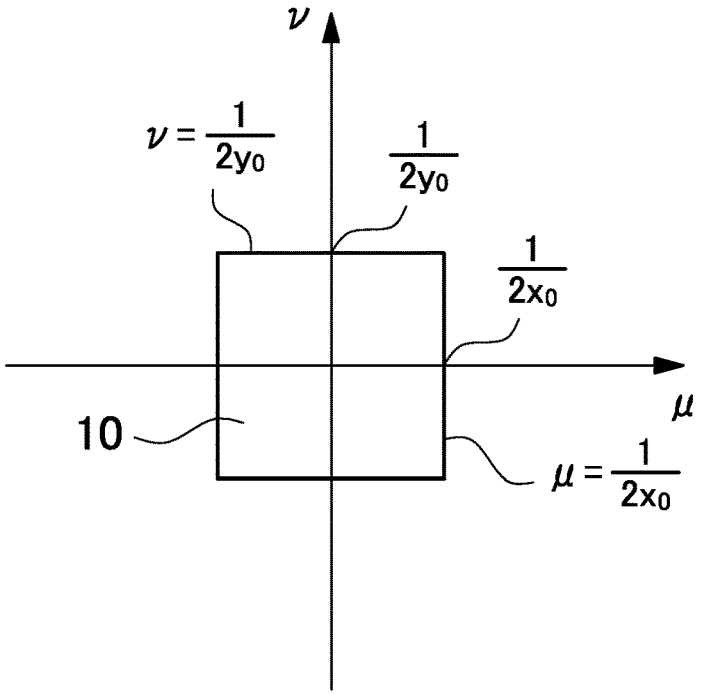
FIG. 4 is a graph showing the region in the spatial frequency domain where display is possible for a comparison example light emitting apparatus.
Figure 5:
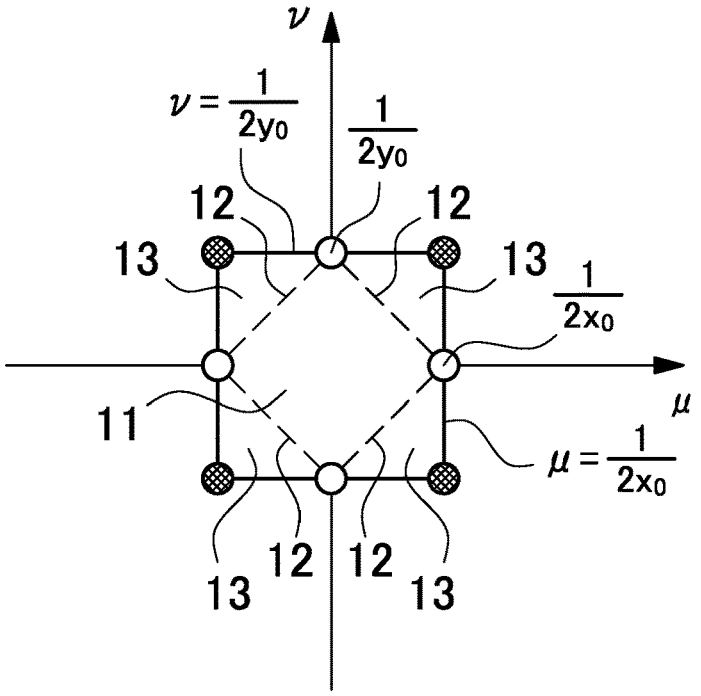
FIG. 5 is a graph showing the region in the spatial frequency domain where light emitting apparatus display is possible.

FIG. 4 is a graph showing the region in the spatial frequency domain where display is possible for the comparison example. FIG. 5 is a graph showing the region in the spatial frequency domain where display is possible for a light emitting apparatus embodiment of the present invention. In these graphs, the μ-axis is spatial frequency in the horizontal direction (x-direction) of the display section, and the ν-axis is spatial frequency in the vertical direction (y-direction). $x_0$ is the light emitting element pitch in the x-direction, which is also the pitch of the grid-points in the x-direction. $y_0$ is the light emitting element pitch in the y-direction, which is also the pitch of the grid-point in the y-direction. Within the region of the spatial frequency domain where display is possible, images can be displayed with more resolution as the spatial frequency increases. However, the region where display is possible is limited to the interior of a rectangular region bounded by the straight-lines: $\mu=\pm\frac{1}{2}x_0$ and $\nu=\pm\frac{1}{2}y_0$, and images with spatial frequency μ greater than $\frac{1}{2}x_0$, and/or spatial frequency ν greater than $\frac{1}{2}y_0$, cannot be displayed. The true-color region is the region of the spatial frequency domain where both color and image geometry are displayed properly, and the color-distortion region is the region where image geometry is displayed properly, but color balance is not maintained.

In the comparison example represented in FIG. 4, the region of spatial frequency where display is possible is the rectangular region bounded by the straight-lines $\mu=\pm\frac{1}{2}x_0$ and $\nu=\pm\frac{1}{2}y_0$, and the true-color region extends over the entire region of spatial frequency where display is possible. Accordingly, there is no color-distortion region where color balance is not maintained.

In the light emitting apparatus of the present embodiment represented in FIG. 5 as well, $x_0$ is the light emitting element pitch in the x-direction and is also the pitch of the grid-points in the x-direction, and $y_0$ is the light emitting element pitch in the y-direction and is also the pitch of the grid-points in the y-direction. Similarly, the region where light emitting apparatus display is possible is inside the rectangular region bounded by the straight-lines $\mu=\pm\frac{1}{2}x_0$ and $\nu=\pm\frac{1}{2}y_0$ the same as for the comparison example. However, the true-color region 11 is the diamond shaped region formed by straight-lines connecting points at $\frac{1}{2}x_0$ and $-\frac{1}{2}x_0$ on the μ-axis, and $\frac{1}{2}y_0$ and $-\frac{1}{2}y_0$ on the ν-axis. Accordingly, the region between the four sides 12 of the true-color region 11 and the straight-lines $\mu=\pm\frac{1}{2}x_0$and $\nu=\pm\frac{1}{2}y_0$ is the color-distortion region 13.

While the light emitting apparatus for the comparison example has a group of light emitting elements 7*a*, 7*b*, 7*c* that emit the three primary colors disposed at each grid-point, the light emitting apparatus of the present embodiment has fewer light emitting elements (light emitting element population is thinned out), and that results in the color-distortion region 13. Since the color-distortion region 13 is outside the four sides 12 (but not including the corner points) of the true-color region 11, color balance is not maintained and color-distortion can result when the spatial frequency of an image obliquely inclined with respect to the x and y-axes is high. However, the spatial frequency domain has a true-color region 11 that includes points at $\pm\frac{1}{2}x_0$ and $\pm\frac{1}{2}y_0$ on the μ and ν axes, and horizontal direction (x-direction) and vertical direction (y-direction) images have the same resolution as those displayed by the comparison example light emitting apparatus.

Figure 6:
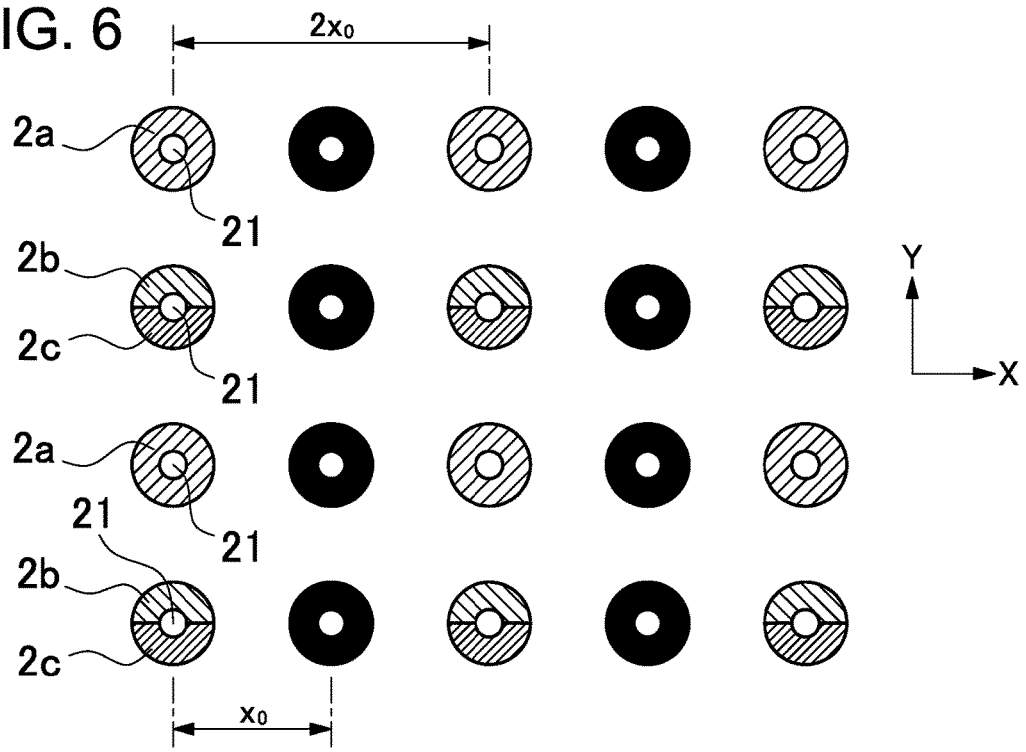
FIG. 6 is a conceptual drawing showing light emitting elements that can be displayed when the x-direction spatial frequency $\mu$ is $\frac{1}{2}x_0$.

FIG. 6 is a conceptual drawing showing light emitting elements that can be displayed when the x-direction spatial frequency μ is $\frac{1}{2}x_0$. As shown in FIG. 6, light emitting elements arrayed in a matrix having and x-direction pitch of $x_0$ are turned ON (activated) in every other column. Light emitting elements that are OFF (not activated) are shown in black. Columns of ON light emitting elements are spaced at intervals of $2x_0$, and light emitting elements 2*a*, 2*b*, 2*c* in the ON columns can be illuminated in a manner that maintains color balance. In an ON column, grid-points where red emitting first light emitting elements 2*a* are disposed are adjacent to grid-points where blue and green emitting second and third light emitting elements 2*b*, 2*c* are disposed together and those grid-points are in a straight-line.

Red color emitted by first light emitting elements 2*a* is complementary to mixed blue and green colors emitted by the second and third light emitting elements 2*b*, 2*c*. Accordingly, even grid-points disposed with an x-direction spatial frequency μ at the $\frac{1}{2}x_0$ point maintain color balance and can render white straight-lines. Similarly grid-points disposed with a y-direction spatial frequency ν at the $\frac{1}{2}y_0$ point also maintain color balance and can display white straight-lines. Compared to the light emitting apparatus of the comparison example shown in FIG. 3, which samples input data at grid-points where light emitting elements 7*a*, 7*b*, 7*c* are disposed as a group that includes all three primary colors, the light emitting apparatus of the present embodiment can reduce the number light emitting elements by half while attaining the same image resolution in the horizontal direction (x-direction) and vertical direction (y-direction).

Figure 7:
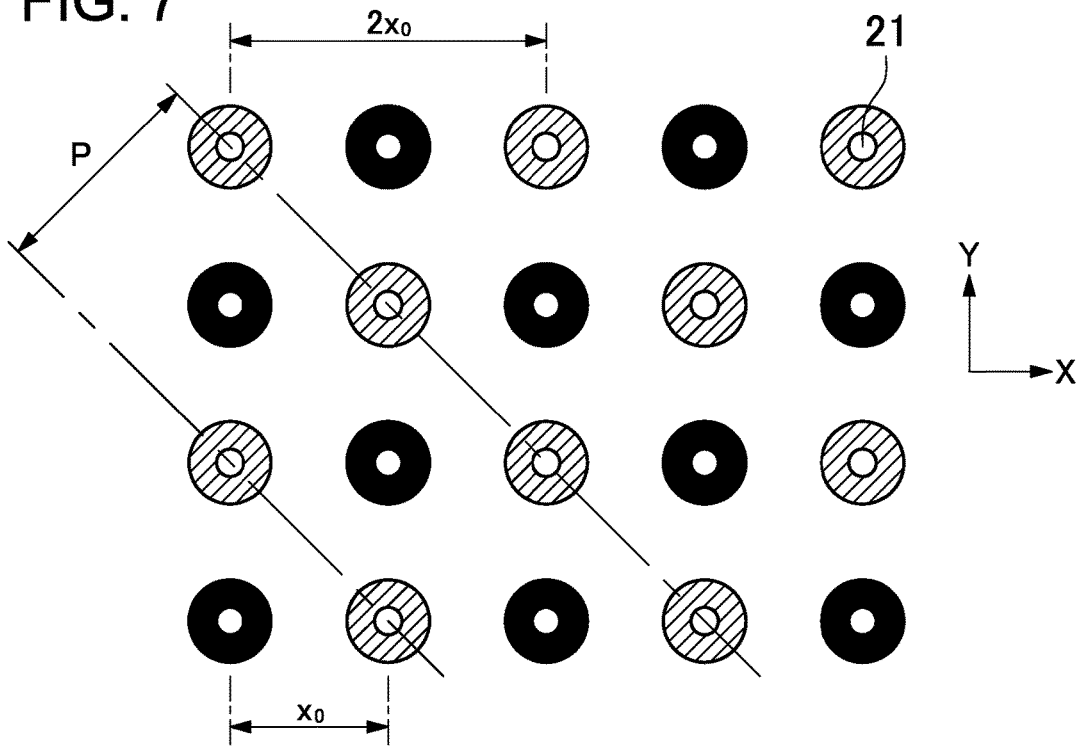
FIG. 7 is a conceptual drawing showing light emitting element activation in the region (in the spatial frequency domain) where color balance is not maintained.

FIG. 7 is a conceptual drawing showing light emitting element activation in the color-distortion region 13 of the present embodiment. While light emitting elements are arrayed with a pitch of $x_0$ in the x-direction, the pitch of obliquely (diagonally) aligned rows of light emitting elements is smaller than the x-direction pitch. In FIG. 7, every other diagonally aligned row of light emitting elements is turned ON (again OFF elements are shown in black). The spacing P between diagonal rows of ON light emitting elements is smaller than $2x_0$. Further, emission color for light emitting elements in the ON rows cannot maintain color balance, and color-distortion can result. However, diagonal rows of light emitting elements that emit colors complementary to colors emitted by light emitting elements in the ON diagonal rows are disposed in straight lines adjacent to the ON rows. Accordingly, if there is movement in a direction perpendicular to the ON diagonal rows of the image, color balance may be maintained due to the after-image effect and the true-color region 11 effectively becomes enlarged.

Figure 8:
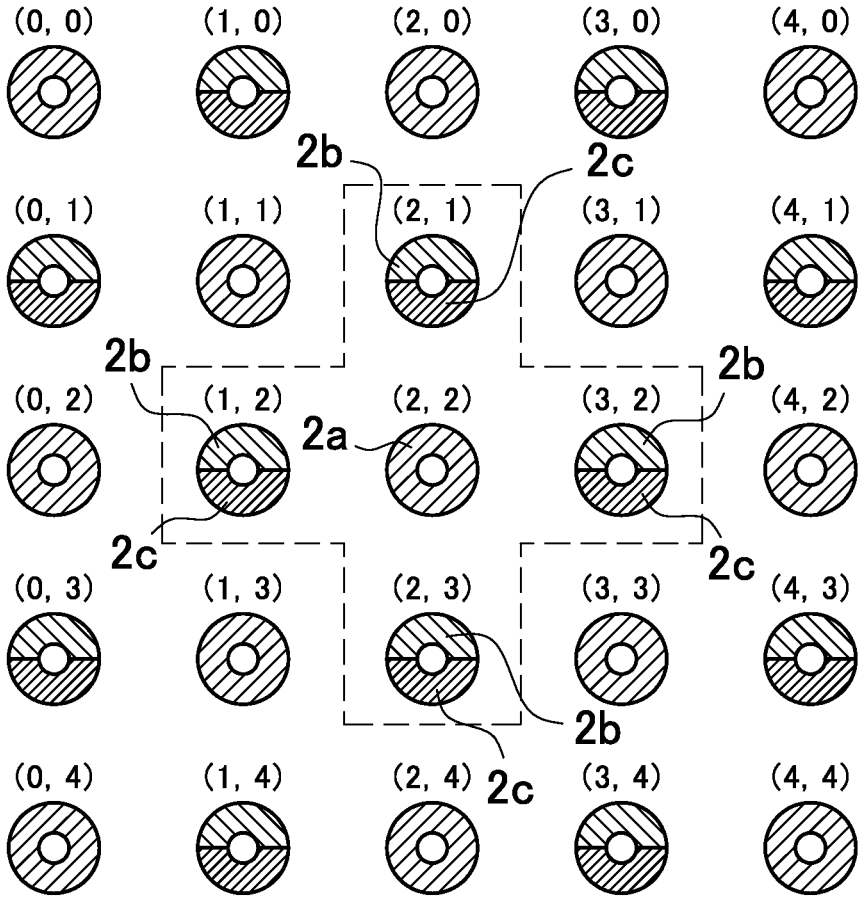
FIG. 8 is a schematic drawing showing grid-points that form a group for the second embodiment of the present invention.

The following describes the second embodiment of the present invention with reference to appropriate figures. As shown in FIG. 8, a group of light emitting elements is formed, for example, by a first light emitting element 2*a* disposed at a first grid-point (2, 2), and second and third light emitting elements 2*b*, 2*c* disposed at adjacent second grid-points (1, 2), (3, 2), (2, 1), (2, 3), which are to the left, right, above, and below the first grid-point (2, 2). First image data corresponding to the first grid-point (2, 2) and second image data corresponding to the second grid-points (1, 2), (3, 2), (2, 1), (2, 3) contain first light emitting element 2*a* emission color information, second light emitting element 2*b* emission color information, and third light emitting element 2*c* emission color information. Here, description is based on the (x, y) coordinates of the grid-points. In these (x, y) coordinate grid-point descriptions, an arbitrary region of the display section 3 is selected, the upper left most grid-point is assigned coordinates (0, 0), the grid-point immediately below is assigned coordinates (0, 1), and the grid-point immediately to the right is assigned coordinates (1, 0). This assignment of (x, y) coordinates can be applied to any one of the embodiments.

First, the first light emitting element 2*a* disposed at the first grid-point (2, 2) is illuminated based on first light emitting element 2*a* color information included in first display data sampled at the first grid-point (2, 2). In addition, the second light emitting element 2*b* disposed at the second grid-point (1, 2) is illuminated based on second light emitting element 2*b* color information included in second display data sampled at the second grid-point (1, 2), and the third light emitting element 2*c* disposed at the second grid-point (1, 2) is illuminated based on third light emitting element 2*c* color information included in the second display data sampled at the second grid-point (1, 2). Light emitting elements disposed at the other second grid-points (2, 1), (2, 3), (3, 2) are illuminated in a similar manner. Specifically, the second light emitting element 2*b* disposed at the second grid-point (2, 1) is illuminated based on second light emitting element 2*b* color information included in second display data sampled at the second grid-point (2, 1), and the third light emitting element 2*c* disposed at the second grid-point (2, 1) is illuminated based on third light emitting element 2*c* color information included in the second display data sampled at the second grid-point (2, 1). The second light emitting element 2*b* disposed at the second grid-point (2, 3) is illuminated based on second light emitting element 2*b* color information included in second display data sampled at the second grid-point (2, 3), and the third light emitting element 2*c* disposed at the second grid-point (2, 3) is illuminated based on third light emitting element 2*c* color information included in the second display data sampled at the second grid-point (2, 3). Further, the second light emitting element 2*b* disposed at the second grid-point (3, 2) is illuminated based on second light emitting element 2*b* color information included in second display data sampled at the second grid-point (3, 2), and the third light emitting element 2*c* disposed at the second grid-point (3, 2) is illuminated based on third light emitting element 2*c* color information included in the second display data sampled at the second grid-point (3, 2). The control procedure described in this paragraph is referred to below as the "first control operation."

Subsequently, the second light emitting element 2*b* disposed at the second grid-point (1, 2) is illuminated based on second light emitting element 2*b* color information included in the first display data sampled at the first grid-point (2, 2), and the third light emitting element 2*c* disposed at the second grid-point (1, 2) is illuminated based on third light emitting element 2*c* color information included in the first display data sampled at the first grid-point (2, 2). In addition, the first light emitting element 2*a* disposed at the first grid-point (2, 2) is illuminated based on first light emitting element 2*a* color information included in the second display data sampled at the second grid-point (1, 2). Similar illumination control is performed at the other second grid-points (2, 1), (2, 3), (3, 2). Specifically, the second light emitting element 2*b* disposed at the second grid-point (2, 1) is illuminated based on second light emitting element 2*b* color information included in the first display data sampled at the first grid-point (2, 2), and the third light emitting element 2*c* disposed at the second grid-point (2, 1) is illuminated based on third light emitting element 2*c* color information included in the first display data sampled at the first grid-point (2, 2). The first light emitting element 2*a* disposed at the first grid-point (2, 2) is illuminated based on first light emitting element 2*a* color information included in the second display data sampled at the second grid-point (2, 1). The second light emitting element 2*b* disposed at the second grid-point (2, 3) is illuminated based on second light emitting element 2*b* color information included in the first display data sampled at the first grid-point (2, 2), and the third light emitting element 2*c* disposed at the second grid-point (2, 3) is illuminated based on third light emitting element 2*c* color information included in the first display data sampled at the first grid-point (2, 2). The first light emitting element 2*a* disposed at the first grid-point (2, 2) is illuminated based on first light emitting element 2*a* color information included in the second display data sampled at the second grid-point (2, 3). Further, the second light emitting element 2*b* disposed at the second grid-point (3, 2) is illuminated based on second light emitting element 2*b* color information included in the first display data sampled at the first grid-point (2, 2), and the third light emitting element 2*c* disposed at the second grid-point (3, 2) is illuminated based on third light emitting element 2*c* color information included in the first display data sampled at the first grid-point (2, 2). Still further, the first light emitting element 2*a* disposed at the first grid-point (2, 2) is illuminated based on first light emitting element 2*a* color information included in the second display data sampled at the second grid-point (3, 2). The control procedure described in this paragraph is subsequently referred to as the "second control operation."

Since no second or third light emitting elements 2*b*, 2*c* are disposed at the first grid-point (2, 2), illumination at the first grid-point (2, 2) based on second light emitting element 2*b* color information or third light emitting element 2*c* color information included in the first display data sampled at the first grid-point (2, 2) is not possible. However, that color information can be used to illuminate second and third light emitting elements 2*b*, 2*c* disposed at second grid-points (1, 2), (2, 1), (2, 3), (3, 2), which are adjacent to the first grid-point (2, 2). Similarly, since no first light emitting element 2*a* is disposed at the second grid-point (1, 2), illumination at the second grid-point (1, 2) based on first light emitting element 2*a* color information included in the second display data sampled at the second grid-point (1, 2) is not possible. However, that color information can be used to illuminate the first light emitting element 2*a* disposed at the first grid-point (2, 2), which is adjacent to the second grid-point (1, 2). More generally, that color information can be used to illuminate first light emitting elements 2*a* disposed at adjacent first grid-points (2, 2), (0, 2), (1, 1), (1, 3), which are to the right, left, above, and below the second grid-point (1, 2). First light emitting element 2*a* color information included in second display data at the other second grid-points (2, 1), (2, 3), (3, 2) can be used in the same manner (to illuminate adjacent first light emitting elements 2*a*).

By implementing these control procedures, off-color effects occurring in the color-distortion region 13 of the second embodiment can be suppressed and color balance can be improved.

The first light emitting element 2*a* disposed at the first grid-point can be grouped with at least one or more of the second and third light emitting elements 2*b*, 2*c* disposed at the four adjacent second grid-points. However, as described above, grouping the first light emitting element 2*a* disposed at the first grid-point with second and third light emitting elements 2*b*, 2*c* disposed at all four adjacent second grid-points is more effective and desirable for suppressing off-color effects occurring in the color-distortion region 13 and improving color balance.

In the "first control operation" and "second control operation" described above, the second and third light emitting elements 2*b*, 2*c* disposed at the second grid-point (1, 2), the second and third light emitting elements 2*b*, 2*c* disposed at the second grid-point (2, 1), the second and third light emitting elements 2*b*, 2*c* disposed at the second grid-point (2, 3), and the second and third light emitting elements 2*b*, 2*c* disposed at the second grid-point (3, 2) can be illuminated in a random order or simultaneously after illuminating the first light emitting element 2*a* disposed at the first grid-point (2, 2). Or, the first light emitting element 2*a* disposed at the first grid-point (2, 2), the second and third light emitting elements 2*b*, 2*c* disposed at the second grid-point (1, 2), the second and third light emitting elements 2*b*, 2*c* disposed at the second grid-point (2, 1), the second and third light emitting elements 2*b*, 2*c* disposed at the second grid-point (2, 3), and the second and third light emitting elements 2*b*, 2*c* disposed at the second grid-point (3, 2) can be all be illuminated simultaneously.

Although the "first control operation" is performed after the "second control operation" in the present embodiment, the system is not limited to that sequence and the "first control operation" and "second control operation" can also be performed simultaneously.

When the light emitting element controller circuit generates display data from input data sampled at grid-points in the manner described above, images based on the input data can be displayed without compromising image resolution even when a reduced number of light emitting elements are employed.

Note that examples described above employ additive color scheme RGB color emission from the first light emitting elements, second light emitting elements, and third light emitting elements. However, subtractive color scheme cyan, yellow, magenta (CYM) colors can also be employed.

The light emitting apparatus, display section, and controller circuit of the present invention can be used with good results in devices such as display devices that display stationary or moving images using LEDs. In addition, the present invention can also be used in "intelligent lighting" applications, which provide dynamic lighting that can change colors using input data that include lighting color information. In that respect, the term "image" used in the present application can have a broader meaning to also include "lighting" and its color specifying data.

What is claimed is:

1. A light emitting apparatus comprising:

a display section having a plurality of packages disposed in a matrix array; and a controller circuit to control illumination of each of the plurality of packages based on input data corresponding to an image to be displayed by the display section, wherein the plurality of packages comprises:

first packages consisting essentially of one or more red light emitting diodes adapted to emit red color; and second packages consisting essentially of one or more green light emitting diodes adapted to emit green color and one or more blue light emitting diodes adapted to emit blue color, the second packages being physically separated from the first packages, wherein a display section matrix is made up of a plurality of grid-points, the second packages are disposed at grid-points that are adjacent in four directions to each grid-point where the first package is disposed, and wherein the controller circuit is configured to sample input data at each grid-point and generate display data to illuminate each package; to control red light emitting diode illumination based on red light emitting diode color information contained in first display data, which are display data sampled at each grid-point where the first package is disposed; to control green light emitting diode illumination based on green light emitting diode color information contained in second display data, which are display data sampled at each grid-point where the second package is disposed; and to control blue light emitting diode illumination based on blue light emitting diode color information contained in the second display data, which are display data sampled at each grid-point where the second package is disposed.

2. The light emitting apparatus as cited in claim 1 wherein a first grid-point, where the first package disposed, is grouped with at least one or more second grid-points, which are adjacent to the first grid-point in four directions and have the second packages disposed at each grid-point, and wherein the controller circuit is configured to illuminate the green light emitting diode disposed at a second grid-point based on green light emitting diode color information in the first display data sampled at the first grid-point; to illuminate the blue light emitting diode disposed at the second grid-point based on blue light emitting diode color information included in the first display data sampled at the first grid-point; and to illuminate the red light emitting diode disposed at the first grid-point based on red light emitting diode color information included in the second display data sampled at the second grid-point.

3. The light emitting apparatus as cited in claim 2 wherein the first grid-point, where the first package disposed, is grouped with adjacent second grid-points in all four directions, and the packages are disposed at each second grid-point.

4. The light emitting apparatus as cited in claim 1 wherein the color emitted by the first package is complementary to mixed colors emitted by the second packages.

5. The light emitting apparatus as cited in claim 1 wherein a peak emission wavelength of the green light emitting diode and a peak emission wavelength of the blue light emitting diode are both be either shorter or longer than the peak emission wavelength of the red light emitting diode.

6. The light emitting apparatus as cited in claim 1 wherein a first grid-point where the first package is disposed and four second grid-points, which are adjacent in four directions to the first grid-point and have the second packages disposed at each grid-point, are oriented such that a line segment connecting a pair of horizontally disposed second grid-points is approximately perpendicular to a line segment connecting a pair of vertically disposed second grid-points.

7. The light emitting apparatus as cited in claim 6 wherein the plurality of grid-points that forms the display section matrix, which can be represented in an (x, y) coordinate system with orthogonal x and y axes, has a pitch between adjacent grid-points of $x_0$ in the x-direction and a pitch of $y_0$ in the y-direction;

wherein data sampled at (x, y) coordinate grid-points can be represented in an image spatial frequency domain via (μ, ν) coordinates with orthogonal μ and ν axes (where the μ-axis is spatial frequency in the x-direction of the display section and the ν-axis is spatial frequency in the y-direction) to define the region of spatial frequency where display is possible;

wherein a true-color region where both color and image geometry are displayed properly is defined for grid-point data sampled within a diamond-shaped region of the image spatial frequency domain having vertices at four (μ, ν) coordinates: $(\frac{1}{2}x_0, 0)$, $(0, \frac{1}{2}y_0)$, $(-\frac{1}{2}x_0, 0)$, and $(0, -\frac{1}{2}y_0)$; and wherein a color-distortion region where image geometry is displayed properly, but color balance is not maintained is defined for grid-point data sampled in a region between the true-color region and a square region of the image spatial frequency domain having vertices at four μν) coordinates: $(\frac{1}{2}x_0, \frac{1}{2}y_0)$, $(-\frac{1}{2}x_0, \frac{1}{2}y_0)$, $(-\frac{1}{2}x_0, -\frac{1}{2}y_0)$, and $(\frac{1}{2}x_0, -\frac{1}{2}y_0)$.

8. The light emitting apparatus as cited in claim 1, wherein each of the first packages is disposed at a first grid-point without the second packages, and wherein the second packages are positioned at a second grid-point without the first packages.

9. A display section comprising:

a plurality of packages disposed in a matrix array, wherein the plurality of packages comprises:

first packages consisting essentially of one or more red light emitting diodes adapted to emit red color; and second packages consisting essentially of one or more green light emitting diodes adapted to emit green color and one or more blue light emitting diodes adapted to emit blue color, the second packages being physically separated from the first packages, wherein a display section matrix is made up of a plurality of grid-points, the second packages are disposed at grid-points that are adjacent in four directions to each grid-point where the first package is disposed;

wherein the display section is configured to control illumination of each package according to display data generated by sampling input data, which corresponds to an image to be displayed by the display section, at each grid-point, and wherein the display section is configured to control illumination of the red light emitting diodes of the first packages based on red light emitting diode color information contained in first display data, which are display data sampled at each grid-point where the first package is disposed; to control illumination of the green light emitting diodes of the second packages based on green light emitting diode color information contained in second display data, which are display data sampled at each grid-point where the second package is disposed; and to control illumination of the blue light emitting diodes of the second packages based on blue light emitting diode color information contained in the second display data, which are display data sampled at each grid-point where the second package is disposed.

10. A controller circuit, which controls illumination of light emitting diodes disposed in a display section matrix array based on input data corresponding to an image to be displayed, the controller circuit comprising:

a display data generator that samples input data at each grid-point where a plurality of packages are disposed and generates display data to illuminate each light emitting diode, wherein the plurality of packages comprises:

first packages consisting essentially of one or more red light emitting diodes adapted to emit red color; and second packages consisting essentially of one or more green light emitting diodes adapted to emit green color and one or more blue light emitting diodes adapted to emit blue color, the second packages being physically separated from the first packages, wherein the controller circuit is configured to control illumination of the red light emitting diodes of the first packages, which emit red color, based on red light emitting diode color information contained in first display data, which are display data sampled at each grid-point where the first package is disposed separately and discretely from the second packages, to control illumination of the green light emitting diodes of the second packages, which emit green color, based on green light emitting diode color information contained in second display data, which are display data sampled at each grid-point where the second packages are disposed, and to control illumination of the blue light emitting diodes of the second packages, which emit blue color, based on blue light emitting diode color information contained in the second display data, which are display data sampled at each grid-point where the second packages are disposed.

11. A method of controlling illumination of light emitting diodes in a light emitting apparatus, the light emitting apparatus including a plurality of packages comprising:

first packages consisting essentially of one or more red light emitting diodes adapted to emit red color; and second packages consisting essentially of one or more green light emitting diodes adapted to emit green color and one or more blue light emitting diodes adapted to emit blue color, the second packages being physically separated from the first packages, the method comprising:

a first control operation that includes control to illuminate the red light emitting diodes of the first packages based on red light emitting diode color information contained in first display data, which are display data sampled at each grid-point where the first package is disposed separately and discretely from the second packages, control to illuminate the green light emitting diodes of the second packages based on green light emitting diode color information contained in second display data, which are display data sampled at each grid-point where the second packages are disposed; and control to illuminate the blue light emitting diodes of the second packages based on blue light emitting diode color information contained in the second display data, which are display data sampled at each grid-point where the second packages are disposed.

12. The method as cited in claim 11 wherein a controller circuit to control illumination of the light emitting diodes based on input data corresponding to an image to be displayed by a display section having the plurality of packages disposed in a matrix array groups each first grid-point, where the first package disposed, with at least one or more second grid-points, which are adjacent to the first grid-point in four directions and have the second packages disposed at each grid-point; and the method further comprises:

a second control operation that includes control to illuminate the green light emitting diode disposed at a second grid-point based on green light emitting diode color information in the first display data sampled at the first grid-point, control to illuminate the blue light emitting diode disposed at the second grid-point based on blue light emitting diode color information included in the first display data sampled at the first grid-point, and control to illuminate the red light emitting diode disposed at the first grid-point based on red light emitting diode color information included in the second display data sampled at the second grid-point.

13. The method as cited in claim 12 wherein the second control operation is performed after the first control operation.

14. The method as cited in claim 12 wherein the first control operation and the second control operation are performed simultaneously.

15. The method as cited in claim 11 wherein the first control operation includes control to illuminate red light emitting diodes based on red light emitting diode color information contained in first display data, which are display data sampled at each grid-point where the first package is disposed;

control to illuminate green light emitting diodes based on green light emitting diode color information contained in second display data, which are display data sampled at each grid-point where the second package is disposed; and control to illuminate blue light emitting diodes based on blue light emitting diode color information contained in the second display data is performed in a sequence, which are display data sampled at each grid-point where the second package is disposed.

16. The method as cited in claim 11 wherein the first control operation includes control to illuminate red light emitting diodes based on red light emitting diode color information contained in first display data, which are display data sampled at each grid-point where the first package is disposed;

control to illuminate green light emitting diodes based on green light emitting diode color information contained in second display data, which are display data sampled at each grid-point where the second package is disposed; and control to illuminate blue light emitting diodes based on blue light emitting diode color information contained in the second display data is performed simultaneously.

17. The method as cited in claim 12 wherein the second control operation includes control to illuminate the green light emitting diode disposed at a second grid-point based on green light emitting diode color information in the first display data sampled at the first grid-point;

control to illuminate the blue light emitting diode disposed at the second grid-point based on blue light emitting diode color information included in the first display data sampled at the first grid-point; and control to illuminate the red light emitting diode disposed at the first grid-point based on red light emitting diode color information included in the second display data sampled at the second grid-point is performed in a sequence.

18. The method as cited in claim 12 wherein the second control operation includes control to illuminate the green light emitting diode disposed at a second grid-point based on green light emitting diode color information in the first display data sampled at the first grid-point;

control to illuminate the blue light emitting diode disposed at the second grid-point based on blue light emitting diode color information included in the first display data sampled at the first grid-point; and control to illuminate the red light emitting diode disposed at the first grid-point based on red light emitting diode color information included in the second display data sampled at the second grid-point is performed simultaneously.

19. A light emitting apparatus comprising:

a display section having a plurality of packages disposed in a matrix array; and a controller circuit to control illumination of each of the plurality of packages based on input data corresponding to an image to be displayed by the display section, wherein the plurality of packages comprises:

first packages consisting essentially of one or more red light emitting diodes adapted to emit red color and one or more blue light emitting diodes adapted to emit blue color; and second packages consisting essentially of one or more green light emitting diodes adapted to emit green color, the second packages being physically separated from the first packages, wherein a display section matrix is made up of a plurality of grid-points; the first packages are disposed at grid-points that are adjacent in four directions to each grid-point where the second package is disposed; and wherein the controller circuit is configured to sample input data at each grid-point and generate display data to illuminate each package; to control green light emitting diode illumination based on green light emitting diode color information contained in first display data, which are display data sampled at each grid-point where the second package is disposed; to control red light emitting diode illumination based on red light emitting diode color information contained in second display data, which are display data sampled at each grid-point where the first package is disposed; and to control blue light emitting diode illumination based on blue light emitting diode color information contained in the second display data, which are display data sampled at each grid-point where the first package is disposed.

20. A light emitting apparatus comprising:

a display section having a plurality of packages disposed in a matrix array; and a controller circuit to control illumination of each of the plurality of packages based on input data corresponding to an image to be displayed by the display section, wherein the plurality of packages comprises:

first packages consisting essentially of one or more red light emitting diodes adapted to emit red color and one or more green light emitting diodes adapted to emit green color; and second packages consisting essentially of one or more blue light emitting diodes adapted to emit blue color, the second packages being physically separated from the first packages, wherein a display section matrix is made up of a plurality of grid-points; the first packages are disposed at grid-points that are adjacent in four directions to each grid-point where the second package is disposed; and wherein the controller circuit is configured to sample input data at each grid-point and generate display data to illuminate each package; to control blue light emitting diode illumination based on blue light emitting diode color information contained in first display data, which are display data sampled at each grid-point where the second package is disposed; to control red light emitting diode illumination based on red light emitting diode color information contained in second display data, which are display data sampled at each grid-point where the first package is disposed; and to control green light emitting diode illumination based on green light emitting diode color information contained in the second display data, which are display data sampled at each grid-point where the first package is disposed.

* * * * *